US008904655B1

(12) United States Patent
Larson

(10) Patent No.: US 8,904,655 B1
(45) Date of Patent: Dec. 9, 2014

(54) FINE ADJUSTMENT MECHANISM FOR ARCHERY BOW SIGHT PINS

(71) Applicant: Marlow W. Larson, Ogden, UT (US)

(72) Inventor: Marlow W. Larson, Ogden, UT (US)

(73) Assignee: Larson Archery Company, Ogden, UT (US)

( * ) Notice: Subject to any disclaimer, the term of this patent is extended or adjusted under 35 U.S.C. 154(b) by 225 days.

(21) Appl. No.: 13/672,680

(22) Filed: Nov. 8, 2012

Related U.S. Application Data

(60) Provisional application No. 61/628,947, filed on Nov. 9, 2011.

(51) Int. Cl.
*F41G 1/467* (2006.01)

(52) U.S. Cl.
CPC ..... *F41G 1/467* (2013.01)
USPC ..... 33/265

(58) Field of Classification Search
CPC ..... F41B 5/14; F41B 5/1442; F41G 1/467
USPC ..... 33/265; 124/87
See application file for complete search history.

(56) References Cited

U.S. PATENT DOCUMENTS

| | | | | |
|---|---|---|---|---|
| 3,854,217 | A * | 12/1974 | Killian | 33/265 |
| 4,543,728 | A * | 10/1985 | Kowalski | 33/265 |
| 5,050,576 | A * | 9/1991 | Larson | 124/87 |
| 5,384,966 | A * | 1/1995 | Gibbs | 33/265 |
| 5,421,315 | A * | 6/1995 | Miller | 124/87 |
| 6,401,347 | B1 * | 6/2002 | Slates | 33/265 |
| 6,922,900 | B1 * | 8/2005 | Henry | 33/265 |
| 2003/0000093 | A1 * | 1/2003 | Larson | 33/265 |
| 2003/0177651 | A1 * | 9/2003 | Stone | 33/265 |
| 2004/0244211 | A1 * | 12/2004 | Afshari | 33/265 |
| 2006/0156561 | A1 * | 7/2006 | Afshari | 33/265 |
| 2007/0227013 | A1 * | 10/2007 | Kaposi | 30/122 |
| 2009/0139100 | A1 * | 6/2009 | Kingsbury | 33/265 |
| 2013/0118019 | A1 * | 5/2013 | Kingsbury et al. | 33/265 |

OTHER PUBLICATIONS

1994 Browning Archery Cat dog, p. 32, printed in USA.

* cited by examiner

*Primary Examiner* — G. Bradley Bennett
(74) *Attorney, Agent, or Firm* — Brian C. Trask

(57) ABSTRACT

An archery bow sight that includes a plurality of sight pins projecting from respective pin holders mounted within guide tracks for elevation adjustment. The sight includes a transport element manually driven by a drive element, both of which are positioned outside the guide tracks. The sight also includes a manipulator element, operable in association with the transport element for selectively engaging respective pin holders, whereby to effect selective individual elevation adjustments of sight pins. Generally, at least one pin holder is releasably secured within a first guide track, at least one pin holder is releasably secured within a second guide track and the manipulator element can selectively couple the transport element to either such pin holder. Sometimes, a yardage indicator mechanism is provided to permit returning a moved sight pin to a known sighted-in position for a given target yardage.

17 Claims, 4 Drawing Sheets

FINE ADJUSTMENT MECHANISM FOR ARCHERY BOW SIGHT PINS

CROSS-REFERENCE TO RELATED APPLICATIONS

This application claims the benefit under 35 U.S.C. 119(e) of the filing date of Provisional Application Ser. No. 61/628,947, filed Nov. 9, 2011, and Titled "ACCESSORY ASSEMBLIES FOR ARCHERY BOWS".

BACKGROUND OF THE INVENTION

1. Field

This application pertains to archery bow accessories, and is directed to pin sights that can be attached to the riser of an archery bow. It is more particularly directed to a fine adjustment mechanism for such pin sights.

2. State of the Art

Pin sights are in extensive use by archery hunters. Several versions have evolved over the years, in response to the changing demands of the marketplace. A principal driving force for pin sight development has been the advancing technology of the archery bows, with which those sights are used.

A traditional fixed-pin sight usually has 3 to 5 pins, which can be individually set for a particular known distance (yardage). The top pin establishes a selected yardage distance, and progressively lower pins establish correspondingly longer distances. Once set, the pins are tightened and remain "fixed" in position during use. Setting up and adjusting a fixed-pin sight is relatively straight forward, but requires some trial and error testing. Bow hunters typically set their fixed-pins for easy-to-remember distances, usually in 5 or 10 yard increments. Once the pins are set, accurately shooting to known distances is readily accomplished. For example, in preparation for launching an arrow at a target 30 yards distant, an archer simply places the pre-set 30-yard pin on the intended target. The sight inherently compensates for the arrow's normal trajectory at that distance. Targets located at unknown distances present a greater challenge. The archer must estimate the distance, and chose the sight pin most appropriate for that distance, making suitable adjustments to account for any difference between the estimated actual distance and the pin's distance setting. A common three pin setup positions individual pins for 20, 30 and 40 yards. A fixed-pin shooter must learn to compensate as necessary for intermediate distances for which no pin is set. If a target is 25 yards away, the 20 yard pin will shoot a bit too low and the 30 yard pin a bit too high. Accordingly, fixed-pin shooters must learn the technique of "gap shooting;" that is, to hold on the target somewhere between the two pins.

Movable sight pins avoid the need for "gap shooting." A moveable pin sight usually has a single pin, which is adjusted before each shot. Moveable pin sights rely upon a system of brackets, levers, or worm gears to smoothly slide the entire sight housing ("pin guard") up and down. The pin can thus be adjusted for any distance within a range in seconds. At the rear of the sight bracket, a small adjustable pointer, linked to the pin, indicates the yardage along a graduated scale (or a series of handmade marks). Each mark represents a known yardage, so the moveable pin sight can be adjusted to any distance by moving the pointer. It is feasible to mark a pin position corresponding to every incremental yard within the distance range of interest. As a practical matter, however, moveable pin scale markings are calibrated at 5 or 10 yard increments. A typical moveable pin sight might be setup with scale marks corresponding to every 5 yards within a 40 yard range, for example 20 to 60 yards. If a target is 27 yards away, the pointer can be set between the 25 and 30 yard scale marks. This system allows yardages to be carefully adjusted on a scale, before the bow string is drawn. In other words, the pin can be placed on the target without further gap adjustment.

Some pin sights provide for "gang adjustment." That feature provides for movement of a group of pins simultaneously. In a typical such arrangement, loosening a screw permits sliding a dovetail bar up or down in a groove. The entire sight housing and all its associated pins are thereby raised or lowered in elevation. Similarly, a separate fastener allows the entire sight housing and associated pins to be moved horizontally, thereby effecting a "windage" adjustment. These capabilities make initial setup and sighting-in easier and provide a greater range of available settings.

Generally, gang adjustments are made by loosening a screw and then sliding the sight housing to a new position. Some such sights incorporate a micro-adjust feature which allows gang windage and elevation adjustments to be made by turning an adjustment knob (usually attached to a simple gear that drives the motion of the housing). These "Micro Adjust" sights are very precise and easy to work with, but they are typically quite expensive.

As compound bows have evolved to deliver faster arrow speeds and flatter trajectories, the space between sight pins (pin gaps) has tended to become smaller. For example, a bow that shoots an arrow faster than 300 feet per second may be paired with a pin sight in which the 20 yard pin is virtually stacked right on top of the 30 yard pin. Close vertical pin spacing is usually accomplished through the use of multiple pin-tracks and/or angled pins such that one pin can be literally set on the edge of another. Sights designed with this feature are said to have "zero pin gap" capability.

A previously known pin sight arrangement improved upon by this invention is embodied in the "Optima Professional" sights disclosed in the 1994 Browning Archery Catalog, the description of which is incorporated by this reference as a portion of this disclosure. That sight mounts individual pins in respective individual pin holders. A plurality of such pin holders are positioned in stacked column arrangement within parallel channels such that the vertical position of each pin is individually adjustable by means of a lead screw (elevation tracking screw). The pins may thus be individually positioned in close proximity within the pin guard of the sight. Because the spacing of adjacent pins within a channel can only be reduced to a lower limit dependent upon the dimensions of the pin holders, (which remain within the channels), these spacings are larger than what is currently regarded as "zero pin gap." To achieve closer spacings requires expedients, such as bent pins, that are undesirable from a manufacturing standpoint, and distracting to an archer.

SUMMARY OF THE INVENTION

This invention provides a fine adjustment mechanism that can be incorporated into archery bow sights of the type that position multiple pin holders within guide tracks, such as a dove tail bar. In its most basic form, the invention provides a transport mechanism, positioned in non-interfering arrangement with respect to the pin holders, constructed and arranged selectively and temporarily to interact with individual pin holders. The transport mechanism functions to release, reposition and lock individual pin holders within their respective guide tracks. A representative such mechanism comprises a transport element mounted to a drive element for movement parallel the tracks housing the pin holders. A manipulator element, associated with the transport element, may then be operated selectively to couple the transport element to a selected a pin holder. It is then further operated to release the pin holder from its locked condition. The transport element is then mechanically driven to a new elevation position, and the manipulator element is operated to lock the pin holder into its new elevation position.

In a presently preferred arrangement, one sight pin, usually a center pin, is fixed to the pin guard, preferably at or near its center. The vertical position of that pin (with respect to the handle riser of the bow) is established by moving the pin guard into its fixed position with respect to the handle riser. The vertical positions of the other pins are thereafter individually adjustable within the pin guard with respect to the fixed pin. The transport mechanism includes a carriage driven by a lead screw. The carriage is associated with a detachable manipulator tool that may be selectively engaged with a pin holder. The tool may be operably connected to the carriage, and may further be operated to both loosen and capture the pin holder. The carriage is then moved, by turning the lead screw, or other mechanical adjustment mechanism, to carry the pin holder and its pin to its destination elevation. The tool is then operated to secure the pin holder in place.

According to one embodiment, individual pins are mounted in respective individual pin holders of the general type utilized by the Optima Professional sight. A plurality of such pin holders are positioned in stacked column arrangement within parallel channels (guide tracks or slots) such that the vertical position of each pin holder is individually adjustable within a channel. Two channels are generally sufficient, but operable embodiments may utilize additional channels. The position of each such pin holder may be individually fixed by mechanical means (such as a set screw) accessible from outside the sight. Each of the pin holders may be individually moved within its channel by means of a traveling adjustment or transport element ("carriage") driven by a single lead screw. The carriage and screw are arranged such that rotation of the lead screw moves the carriage up or down parallel to the channels and thus may position a coupled pin holder. The carriage may be selectively coupled to an individual pin holder, which may then be loosened and elevated or lowered within the channel and retightened into its new vertical position.

Various mechanisms and arrangements are operable to couple the carriage to a selected pin holder, and to loosen and tighten the pin holder with respect to the slot. One suitable arrangement is to provide one or more access openings through the carriage. The lead screw can then be operated to bring an access opening into registration with a pin holder, and the pin holder can then be manipulated through the opening. For example, the pin holder may be constructed for loosening or tightening within its associated guide track by means of a conventional fastener, such as a set screw, positioned for access through an opening in the carriage. A presently preferred form of set screw is a socket head cap screw. A tool configured to pass through the opening into registration with a socket end of the fastener serves as the means for loosening the pin holder. It also serves as means for translating the vertical movement of the carriage to the pin holder, as well as to hold the pin holder during vertical movement of the pin holder in the guide track. After the pin holder has been brought to its intended vertical position, the tool (which may be an Allen wrench or its equivalent) serves as means for again tightening the pin holder in place. Individual pins corresponding to sequential yardages may be positioned within parallel guide tracks (channels) so that they may be grouped within a "zero pin gap" configuration, without the need for bending.

In summary, this invention provides an improvement to an archery bow sight of the type that includes a plurality of sight pins projecting from respective pin holders that are mounted within guide tracks for elevation adjustment. The improved sight includes multiple guide tracks. Accordingly, at least one pin holder is releaseably secured within each of at least two guide tracks. The improvement comprises a transport element manually driven by a drive element, both such elements being positioned outside (remote from) the guide tracks, and a manipulator element, operable in association with the transport element. The manipulator element and the transport element are constructed and arranged for selectively engaging respective pin holders, whereby to effect selective individual elevation adjustments of the individual pins.

According to certain preferred embodiments, the drive element, which may be a lead screw, is positioned to move the transport element, which may comprise a body member with a threaded bore mated to the lead screw, approximately parallel the guide tracks. One version of a suitable transport element comprises a body member with apertures transverse the lead screw, arranged to be brought into registration with selected pin holders by operation of the lead screw. A suitable manipulator element comprises a hand tool with a proximal end and a distal end, the distal end being structured for coupling engagement with locking structure carried by respective pin holders. The apertures and the distal end of the tool are cooperatively structured and arranged so that the locking structure carried by a selected pin holder may be accessed by the distal end through a selected aperture when that aperture is in registration with the selected pin holder.

BRIEF DESCRIPTION OF THE FIGURES

In the drawings, which illustrate what is currently regarded as the best mode for carrying out the invention.

DETAILED DESCRIPTION OF THE ILLUSTRATED EMBODIMENT

Figure 1:
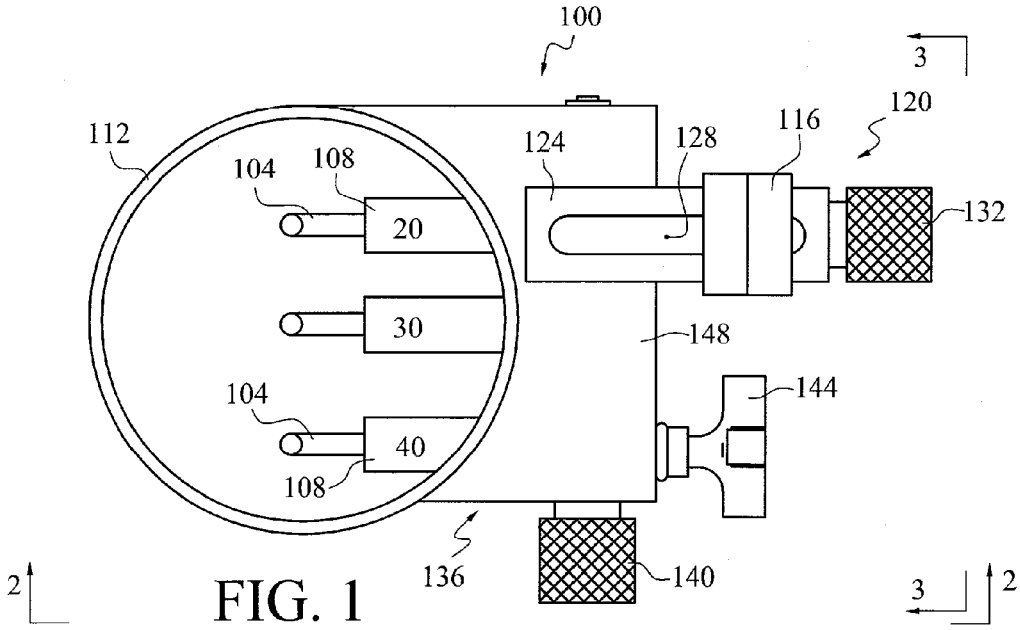
FIG. 1 is an archer's view in elevation of the proximal end of a sight assembly structured according to certain principles of the invention.
Figure 2:
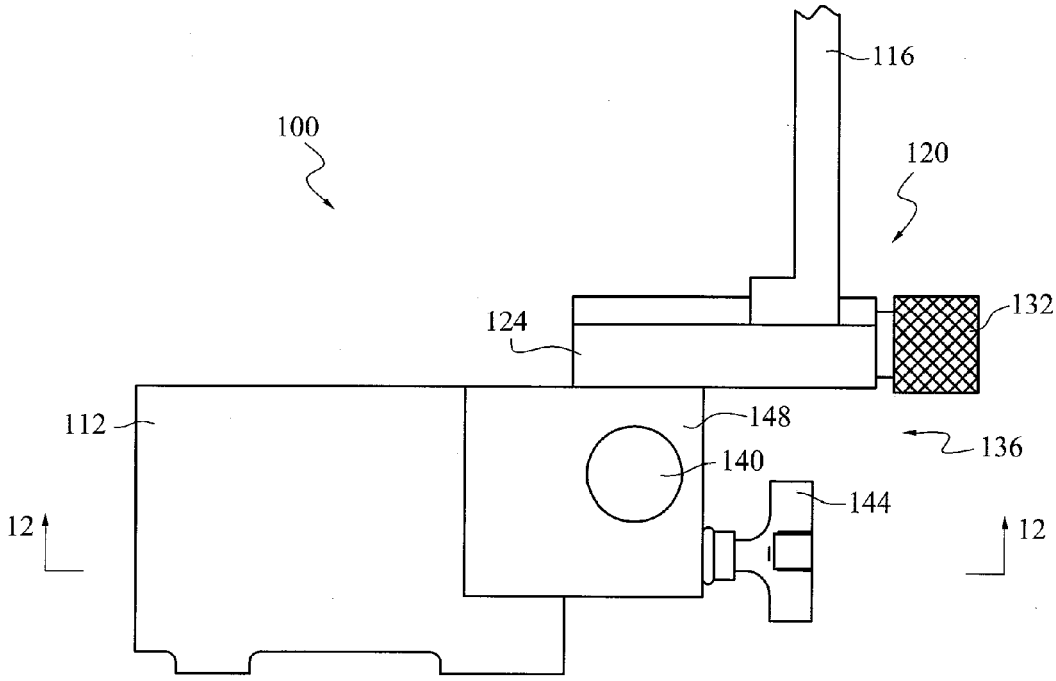
FIG. 2 is a side view of the embodiment illustrated in FIG. 1, indicated at section 2-2 in FIG. 1, and looking in the direction of the arrows.

An exemplary archery sight structured according to certain principles of the invention is illustrated in FIG. 1, and is generally indicated at 100. With reference to FIGS. 1 and 2, archery sight 100 includes a plurality of pins 104, each of which is carried by an associated pin holder 108. A pin guard 112 is desirably provided to protect individual pins from being struck and accidentally moved or bent from a desired "sighted-in" position. As illustrated in FIG. 1, a pin holder 108 may sometimes carry yardage-indicating indicia to indicate the sight-in distance for certain respective pins to an archer who is sighting at a target. Although such is not illustrated for clarity and simplicity, it is within contemplation that fiber optic elements may be included in alternative pin embodiments of sights structured according to certain principles of the invention.

The illustrated sight 100 includes a mounting strut 116, which is conventionally mounted to the riser or handle of a bow. Desirably, a windage adjustment mechanism, generally 120, is included to facilitate simultaneous left or right adjustment of the position of all pins 104. Simultaneously moving the pin guard 112 and all pins 104 protected therein permits the target spots of all the pins to remain in desirable proximity to a vertical axis passing through the center of the pin guard 112. Exemplary windage adjustment mechanism 120 includes a dovetail interface between mounting strut 116 and cross-rail 124. A portion of strut 116 passes through slot 128, and is engaged with a lead screw that is turned by windage drive interface knob 132. Therefore, rotation of knob 132 in one direction moves the entire group of pins 104 to the left, and rotation of knob 132 in the other direction moves the entire group of pins 104 to the right.

It should be noted that a level vial (not illustrated) may be included in certain embodiments to facilitate proper bow alignment with respect to the vertical direction while aiming at a target. Furthermore, certain embodiments (not illustrated for simplicity and clarity of disclosure) may include provision (similar to the windage adjustment) to move the pin guard up or down in a vertical direction, to thereby simultaneously and at least roughly, orient the entire assembly of pins 104 at a position such that individual pins 104 may be dispersed within the useable area inside the pin guard 112 for all desired and realistically usable sight-in distances.

One aspect of the invention provides a pin drive mechanism, generally 136, operable to adjust the fixed or held pin position for individuals of a selectable plurality of individual pins 104. Note that pins 104 and their associated pin holders 108 move in tandem. That means, moving a selected pin holder 108 inevitably moves its associated pin 104 by a corresponding amount. Also, for purpose of this disclosure, the phrase "a pin drive mechanism operable to selectively adjust one of either a first pin holder or a second pin holder" means that each of the first and second pin holders is separately adjustable. That means that adjusting the position of the first pin holder does not also change the position of the second pin holder. Further, the same pin drive mechanism must be capable of adjusting either the first or second pin holder.

In part, the illustrated pin drive mechanism 136 includes pin drive interface knob 140, and manipulator element 144. As explained in more detail below, pin drive mechanism 136 may be used to adjust a selected pin holder 108 between a plurality of vertically spaced-apart held positions with respect to housing 148. In preferred embodiments, the number of available held positions is virtually infinite.

Figure 5:
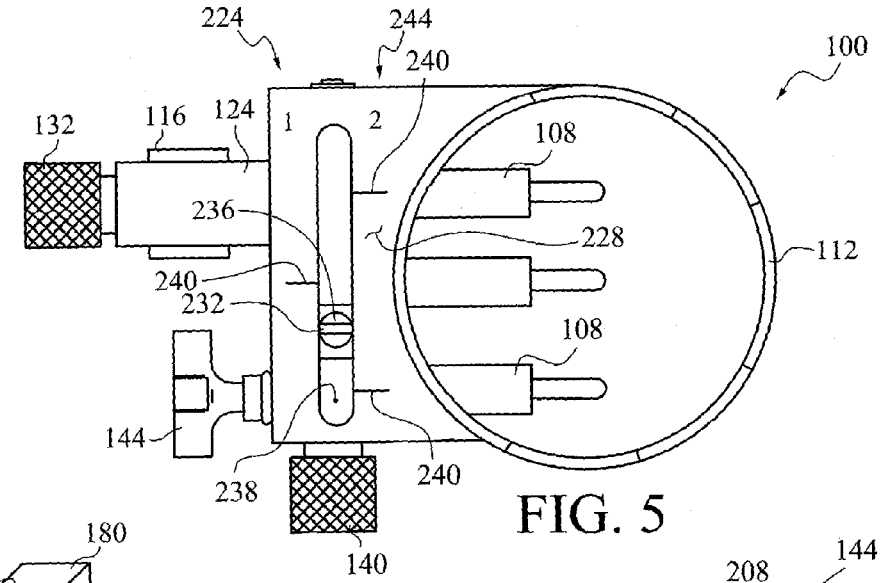
FIG. 5 is a view in elevation of the distal end of the sight assembly of FIG. 1.

Preferably, various portions of a pin drive mechanism 136 can be used in cooperation to release a selected single pin holder 108 from fixed engagement with respect to structure associated with housing 148, displace the selected pin holder 108 to a desired position, and again affix the selected pin holder 108 with respect to housing 148 at the desired position. If desired, a pin drive mechanism 136 can then be employed to select and position a different pin holder 108. Illustrated pin drive mechanism 136 provides an enhanced degree of mechanical precision to the positional adjustment of a selected pin 104, compared to simply moving a selected pin holder 108 under only manual input. It should be noted that the manipulator element 144 illustrated in FIGS. 1, 2, and 5 is disposed in an optional storage position.

Figure 3:
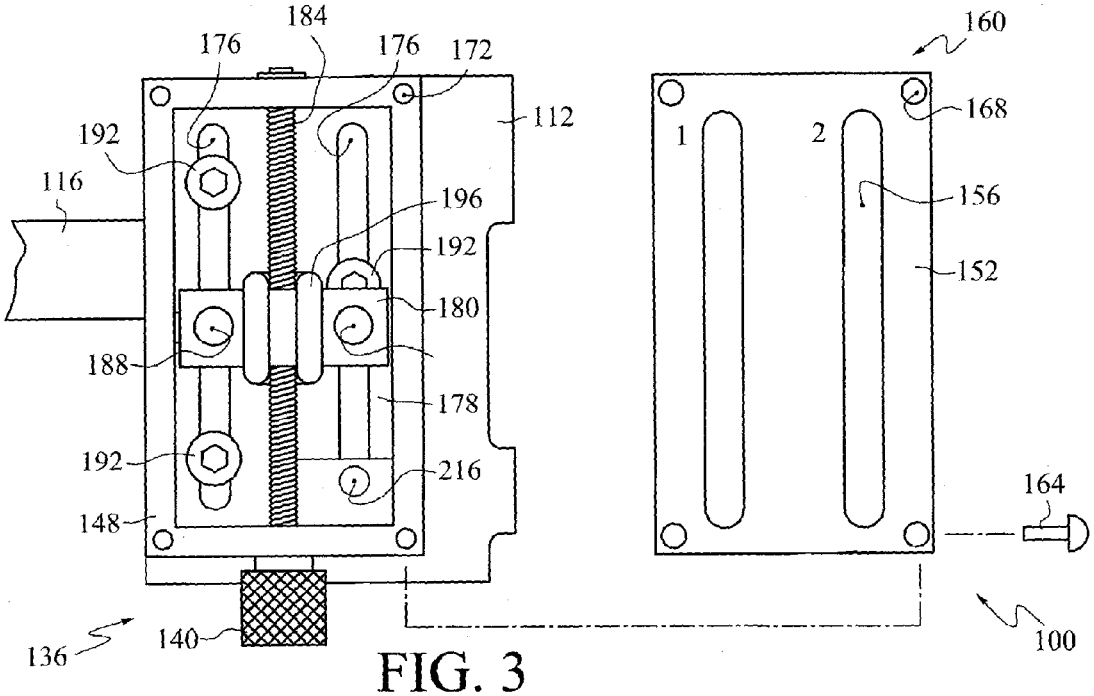
FIG. 3 is a side assembly view, partially exploded, indicated at section 3-3 in FIG. 1, and looking in the direction of the arrows.
Figure 7:
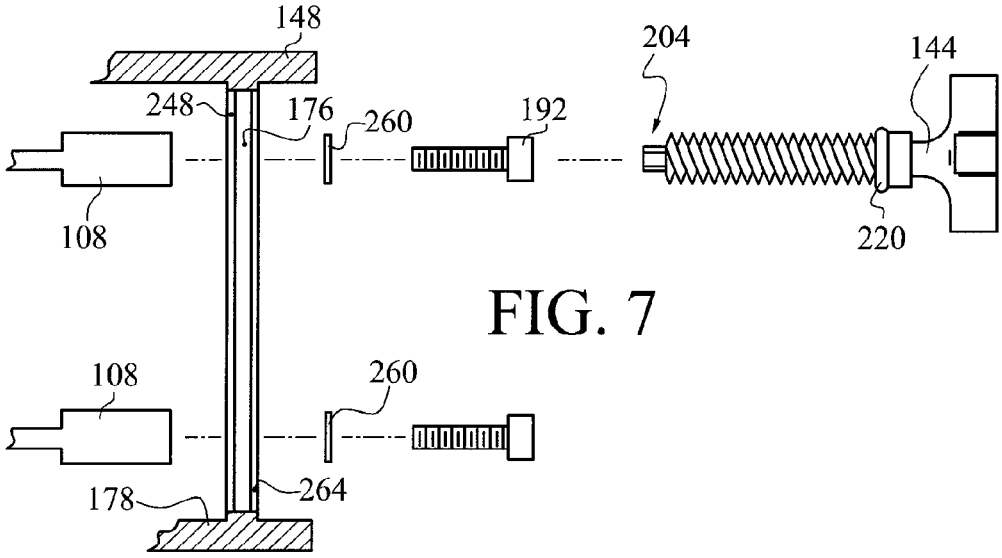
FIG. 7 is an exploded assembly view, partially in cross-section, of a working portion of the sight in FIG. 1.
Figure 8:
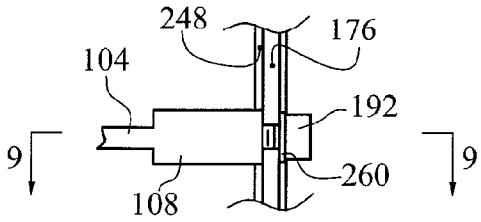
FIG. 8 is an assembled view of a portion of structure in FIG. 7.

FIG. 3 shows a view looking into the inside of housing 148 by removing the cover 152. Cover 152 includes a pair of cover slots 156 that are sized to receive penetration by a probe portion of manipulator element 144 for reciprocation of an inserted manipulator element 144 along the length axis of a slot 156. Sometimes, indicia, generally indicated at 160, may be provided to designate slots by number, or by some other identification-conveying symbol. Illustrated cover 152 is maintained in installed registration on housing 148 by way of a plurality of fasteners 164 received through holes 168, and engaged in holes 172.

Looking into the interior of housing 148 in FIG. 3, one can see a pair of guide tracks 176 disposed in a partition wall 178 of housing 148. Guide tracks 176 provide slots along a length axis of which pin holders 108 may reciprocate. A transport element 180 (sometimes made reference to as a carriage) is carried for precisely controllable reciprocation by drive element 184. Illustrated drive element 184 includes a lead screw portion connected to pin drive interface knob 140. Through-hole 186 (see FIG. 6) of carriage 180 is threaded to receive, and reciprocate along a length axis of, the lead screw portion of drive element 184. Rotation of knob 140 in one direction or the other causes carriage 180 to correspondingly move either up, or down.

Carriage 180 includes a pair of access openings 188, which extend entirely through the carriage element. Inspection of FIG. 3 shows that access openings 188 are disposed to register with the length axes of the slots 176 when carriage 180 is reciprocated by drive element 184. During reciprocation of carriage 180, access openings 188 correspondingly and selectively register with individual holding elements associated with individual pin holders 108, such as socket head cap screws 192.

It is currently preferred to provide vibration-dampening structure, such as O-ring 196, to resist rattling or vibration and consequential noise generated between elements of a pin drive mechanism 136. O-ring 196 is self-biased on assembly to urge carriage 180 into a compression contact with the lead-screw portion of drive element 184. O-ring 196 may be characterized as having first and second anchor portions disposed to wrap behind the lead screw portion of drive element 184 at opposite sides of carriage 180 such that connection portions spanning between the anchor portions are disposed on the same side of carriage 180.

Figure 12:
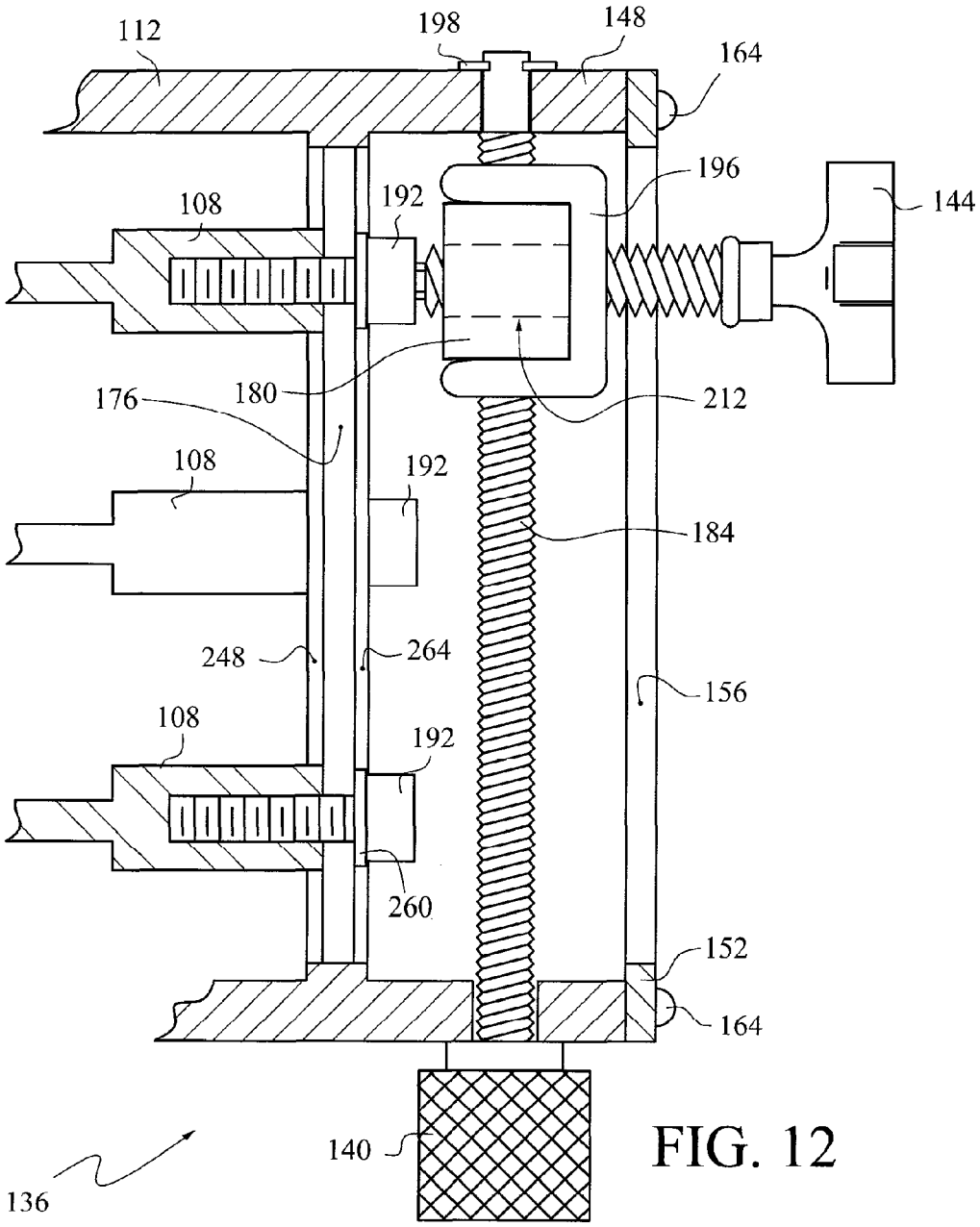
FIG. 12 is a schematic view, partially in cross-section, taken at section 12-12 in FIG. 2 and with the manipulator element engaged with a selected holding element.

An O-ring (not illustrated) can also be disposed circumferentially around the lead-screw of mechanism 184 for compression between knob 140 and an external surface of housing 148. In such case, a small amount of compression can be imposed to squash such O-ring during installation of a split ring 198 (see FIG. 12) that holds drive mechanism 184 in installed position. Such pre-loaded O-ring would further resist creation of noise, as well as reduce back-lash of drive element 184.

Figure 4:
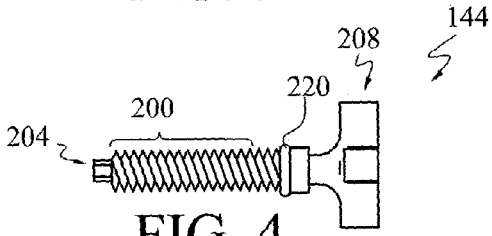
FIG. 4 is a side view in elevation of an exemplary manipulator element that may be included, and used, with the sight embodiment of FIG. 1.
Figure 9:
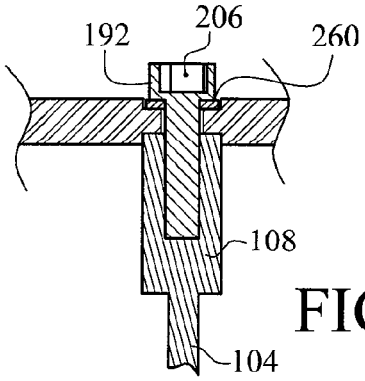
FIG. 9 is a cross-section view taken through the section 9-9 in FIG. 8, and looking in the direction of the arrows.
Figure 10:
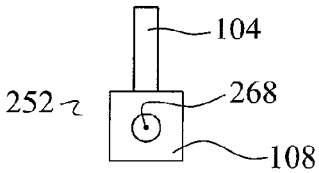
FIG. 10 is an end view of a pin holder.
Figure 11:
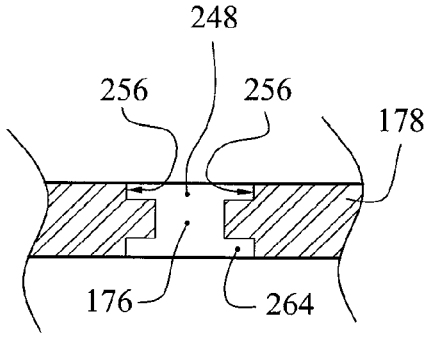
FIG. 11 is a cross-section view of the slot in which the pin holder in FIG. 10 may be installed for reciprocation.

With reference now to FIG. 4, exemplary manipulator element 144 includes a probe portion, generally 200, a tool portion, generally 204, and a drive interface, generally 208. Manipulator element 144 desirably is formed to cooperate with an access opening 188 such that the probe portion 200 may be slid into an opening 188, and subsequently rotated about the length axis of probe portion 200. When carriage 180 is properly positioned, tool portion 204 may engage with a holding element, such as inside the socket 206 (see FIG. 9) of a cap screw 192. Illustrated tool portion 204 is effectively an Allen wrench. An alternative, albeit less desirable, operable tool portion 204 may be embodied as a screwdriver tip, such as a Phillip's head point, or other configuration capable of providing alignment of a carriage 180 and a selected pin 104. A user can then apply a rotational command input to drive interface 208 such that manipulator element 144 may then loosen the holding element 192 to permit adjustment in a held position of a pin holder 108.

Desirably, walls 212 (see FIG. 12) of opening 188 engage probe portion 200 to resist excessive rotation of element 144 about tool portion 204 when carriage 180 is subsequently reciprocated effective to adjust a held position of a selected pin holder 108. It is currently preferred to provide an accurate slip-fit between walls 212 and probe portion 200, to provide a relatively precise registration between the vertical position of carriage 180 and a pin position at which tool portion 204 interfaces with a holding element, such as socket head cap screw 192.

With reference now to FIGS. 3 and 4, it is preferred to provide secure on-board storage of a manipulator element 144. Such secure storage is defined as being sufficient to resist loss of such component of a sight 100 during the conventional and expected transportation and use of a bow on which a sight 100 is mounted. One workable secure storage system includes a threaded end portion of probe portion 200, which is structured for threaded engagement inside correspondingly threaded receiving hole 216 of housing 148. As illustrated, some way to resist undesired removal of a stored manipulator element 144 is desirably provided. An O-ring 220 may be carried by manipulator element 144 at a position that places the O-ring 220 into compression against a portion of cover 152 when the tool 144 is installed in a storage position. Such exemplary illustrated structure resists undesired unscrewing of the manipulator element 144 from the installed position to resist loss of manipulator element 144.

Figure 6:
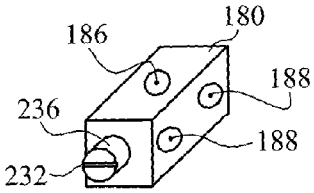
FIG. 6 is a view in perspective of an exemplary transport element.

With reference now to FIGS. 5 and 6, certain sights 100 may include a yardage indicator mechanism, generally 224, operable to display pin locations reflecting known sighted-in pin positions for certain distances. Exemplary indicator mechanism 224 includes a yardage indicator surface 228, and an indicating pointer line 232. Carriage 180 carries a pointer extension 236 desirably sized in length to extend through slot 238 effective to bring pointer line 232 at least approximately into the plane of indicator surface 228. Pointer line 232 corresponds with the vertical position of carriage 180.

When a user has sighted-in a selected pin 104 at a desired yardage distance, carriage 180 may be positioned such that manipulator element 144 may engage the holding element 192 corresponding to that sighted-in pin 104. The user may then make a mark 240 (e.g. a removable pencil line) on surface 228 in alignment with pointer line 232. If that pin 104 is subsequently moved to a different sighted-in distance, the user may return that moved pin 104 to its marked sighted-in yardage distance by capturing and loosening the holding element 192 of the associated pin holder 108, then moving that pin holder 108 with assistance of carriage 180 and manipulator element 144 to align the corresponding mark 240 with the pointer line 232. Then the manipulator element 144 is used to tighten the holding element 192 effective to retain the selected pin 104 at the marked sighted-in yardage position.

Sometimes, it is desirable to include yardage indicia, generally 244, to indicate correspondence of a yardage mark 240 and the associated slot 176 in which the corresponding pin holder 108 resides. Desirably, indicia 244 and indicia 160 are mutually reinforcing. That is, and as illustrated, the portion of surface 228 designated by a number 1 corresponds to the slot designated by a counterpart number 1.

Additional structural details of a preferred sight 100 are illustrated in FIGS. 7-12. It is currently preferred that a guide track 176 includes a socket 248 structured to cooperate with a proximal end of a pin holder 108 effective to permit reciprocation of the pin holder 108, but resist rotation of the holder 108 during such translation along slot 176. For example, flat sides 252 of pin holder 108 are illustrated as fitting snuggly between walls 256 of socket 248. Sometimes, a similar arrangement may be provided between optional washer(s) 260 and socket 264. A fastener 192 may be received in threaded hole 268 to compress the proximal end of a pin holder against the floor/shoulder of socket 248, and hold a corresponding pin 104 at a held position.

While the invention has been described in particular with reference to a certain illustrated embodiment, such is not intended to limit the scope of the invention. The present invention may be embodied in other specific forms without departing from its spirit or essential characteristics. The described embodiment is to be considered as illustrative and not restrictive. The scope of the invention is, therefore, indicated by the appended claims rather than by the foregoing description. All changes which come within the meaning and range of equivalency of the claims are to be embraced within their scope.

What is claimed is:

1. In an archery bow sight of the type that includes a plurality of sight pins projecting from respective pin holders that are mounted within guide tracks for elevation adjustment, the improvement comprising a transport element manually driven by a drive element, both positioned outside said guide tracks, and a manipulator element, operable in association with said transport element constructed and arranged for selectively engaging respective said pin holders, whereby to effect selective individual elevation adjustments of said pins.

2. The improvement of claim 1, wherein at least one said pin holder is releasably secured within a first said guide track, at least one said pin holder is releasably secured within a second said guide track and said manipulator element is constructed and arranged selectively to couple said transport element to a selected said pin holder.

3. The improvement of claim 1, wherein said drive element is positioned to move said transport element approximately parallel said tracks.

4. The improvement of claim 3, wherein said drive element is a lead screw.

5. The improvement of claim 3, wherein said transport element comprises a body member with apertures arranged to be brought into registration with selected said pin holders by operation of said drive element.

6. The improvement of claim 5, wherein said manipulator element comprises a hand tool with a proximal end and a distal end, said distal end being structured for coupling engagement with locking structure carried by respective said pin holders, said apertures and said distal end being cooperatively structured and arranged so that the locking structure carried by a selected pin holder may be accessed by said distal end through a said aperture when that said aperture is in registration with said selected pin holder.

7. An archery bow sight, comprising:

a housing;

a plurality of guide tracks carried by a partition wall of said housing;

a plurality of pin holders, at least one pin holder being disposed for reciprocation along the length axis of each guide track; and a pin drive mechanism operable to selectively adjust one of either a first pin holder or a second pin holder.

8. The archery bow sight according to claim 7, wherein:

said pin drive mechanism comprises:

a carriage disposed for reciprocation parallel to said length axis of each guide track; and a manipulator element configured to selectively couple with both of said carriage and either a first holding element associated with said first pin holder or a second holding element associated with said second pin holder.

9. The archery bow sight according to claim 8, wherein:

said carriage is carried by a lead screw; and a direction of travel of said carriage is determined by a corresponding direction of rotation of said lead screw.

10. The archery bow sight according to claim 8, wherein:

said manipulator element comprises:

a tool portion structured to couple with said first holding element effective to permit loosening said first holding element, transferring an imposed displacement of said carriage to said first pin holder, and subsequently tightening said first holding element;

a probe portion structured for penetration through cooperatingly configured receiving structure of said carriage; and a drive interface through which to receive a user's control input effective to operate said tool portion.

11. The archery bow sight according to claim 7, wherein:

said first pin holder and said second pin holder are disposed for reciprocation along the length axis of the same guide track.

12. The archery bow sight according to claim 7, wherein:

said first pin holder and said second pin holder are disposed for reciprocation along the length axes of different guide tracks.

13. The archery bow sight according to claim 10, wherein:

said receiving structure comprises at least a first through-hole and a second through-hole, each such through-hole being sized in diameter to receive said probe portion in a slip fit effective to register a vertical position of said carriage with a vertical position of either a respective one of said first pin holder or said second pin holder with which said tool portion is coupled.

14. The archery bow sight according to claim 13, further comprising:

a yardage indicator mechanism operable to record a plurality of yardage marks, each such mark corresponding to a position at which a selected sight pin is sighted-in for a known range to a target.

15. The archery bow sight according to claim 14, wherein:

said carriage carries a pointer extension with an indicating pointer line disposed at a distal end thereof, said pointer extension being configured to protrude into a slot formed in said housing effective to dispose said indicating pointer line in approximate congruence with an indicator surface associated with said housing; and said indicator surface is structured to permit a user to place a plurality of yardage marks thereon to permit moving a selected sight pin from an original sighted-in position associated with a corresponding yardage mark and subsequently to permit returning said selected sight pin to said original sighted-in position by aligning said pointer line with said corresponding yardage mark, each said yardage mark being user-placed in alignment with said indicator pointer line when said carriage is disposed to permit said manipulator element to couple with the holding element of a corresponding selected sight pin holder.

16. The archery bow sight according to claim 9, further comprising:

a resilient element disposed to bias two members of said pin drive mechanism toward one another effective to resist generation of noise between such members during operation of an archery bow on which said sight is installed.

17. The archery bow sight according to claim 16, wherein:

a first of said members comprises said lead screw;

a second of said members comprises said carriage; and said resilient element is an O-ring having first and second anchor portions disposed to wrap behind said lead screw at opposite sides of said carriage such that connection portions spanning between said anchor portions are disposed on the same side of said carriage.

* * * * *